United States Patent [19]

Gabriel

[11] Patent Number: 4,647,095

[45] **Date of Patent: * Mar. 3, 1987**

[54] HOIST CABLE COUPLING DEVICE (FOR SUSPENDED LOADS)

[76] Inventor: Edwin Z. Gabriel, 91 Mt. Tabor Way, Ocean Grove, N.J. 07756

[ * ] Notice: The portion of the term of this patent subsequent to Aug. 20, 2002 has been disclaimed.

[21] Appl. No.: 746,550

[22] Filed: Jun. 19, 1985

[51] Int. Cl.[4] ..... B66C 1/34

[52] U.S. Cl. ..... 294/82.24

[58] Field of Search ..... 294/82.24, 82.32, 82.30, 294/65.5, 82.25, 904, 82.29, 82.27, 86.4, 906, 88, 90, 106, 110.1, 113; 24/453; 244/151 B, 137 R

[56] References Cited

U.S. PATENT DOCUMENTS 4,536,024 8/1985 Gabriel ..... 294/81.24

*Primary Examiner*—James B. Marbert

[57] ABSTRACT

A hoist cable coupling device comprising a lower scissor-like part and an upper doughnut-shaped part, in which blades of the scissor-like part extend through the ring part and are locked in place when suspending a load. Hoist cables are attached to its upper part and load cables to its lower part. When the locking mechanism is of the magnetic type, it is so designed and so placed in a recess portion of the scissorlike part that it can be removed by personnel with ease whenever so desired. When the locking mechanism is of the solenoid type, it is an integral part of the scissor-like part with its plunger projecting into the same recess as above, when suspending cargo. The plunger is shaped to retract or rotate easily whenever required to unload cargo. In either locking technique, positive load-cable retension is acquired. The device cannot become unlocked by itself and be decoupled without action on the part of personnel.

13 Claims, 40 Drawing Figures

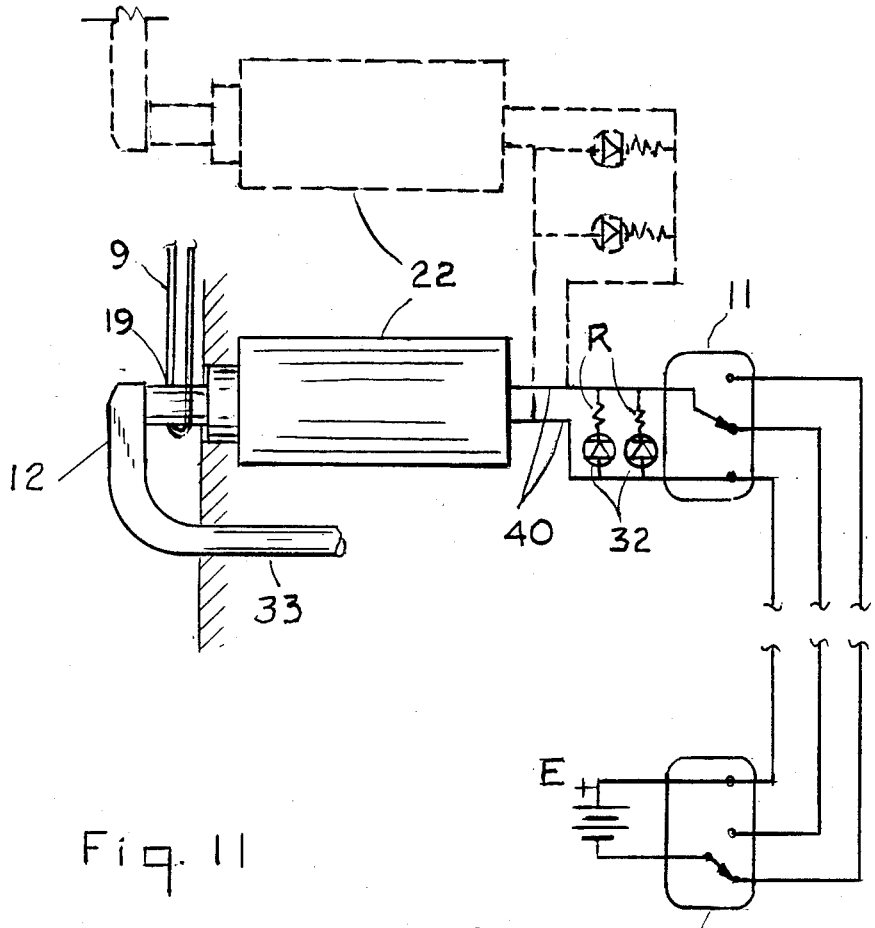
Fig. 11
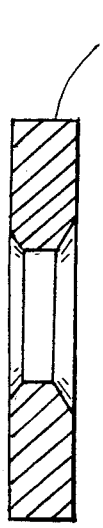
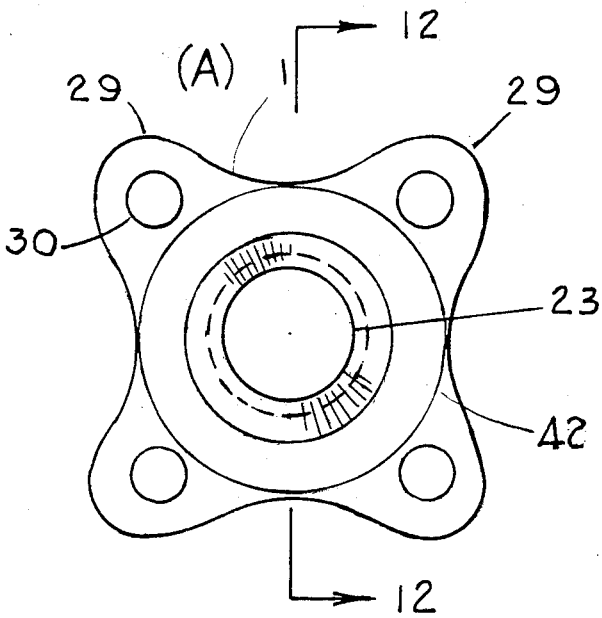
Fig. 12 Fig. 13

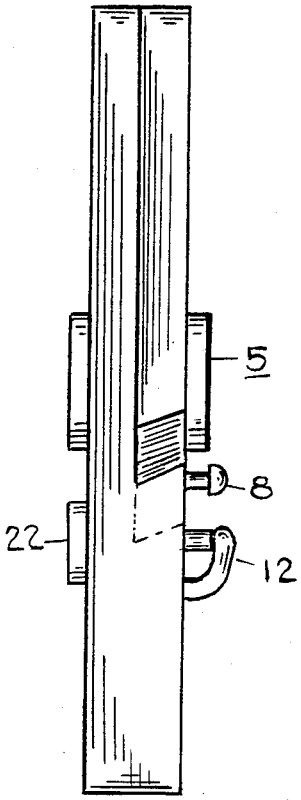
Fig. 17
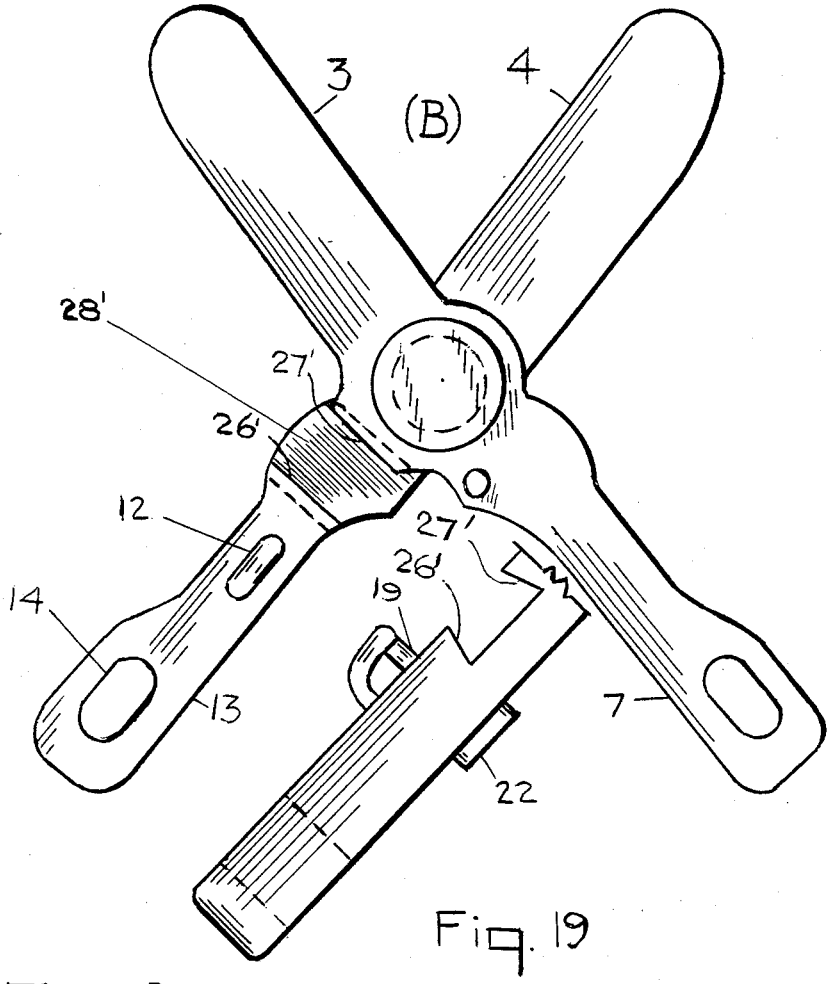
Fig. 18
Fig. 19
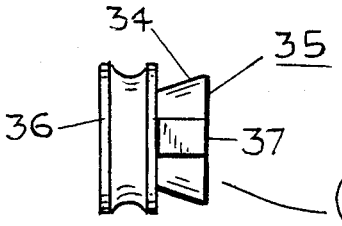
Fig. 16A
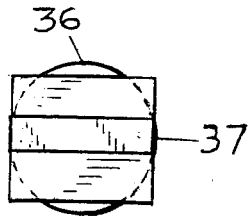
Fig. 16B

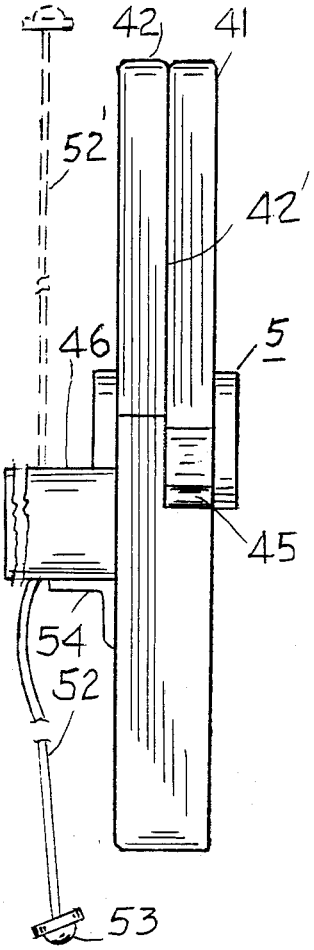
Fig. 22
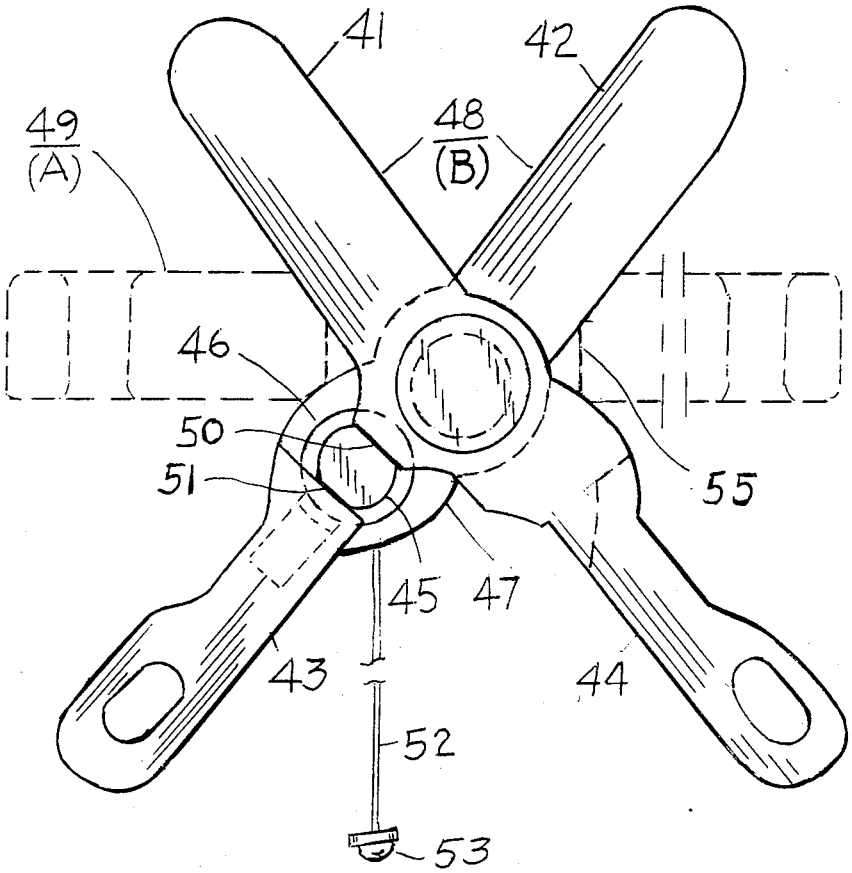
Fig. 23
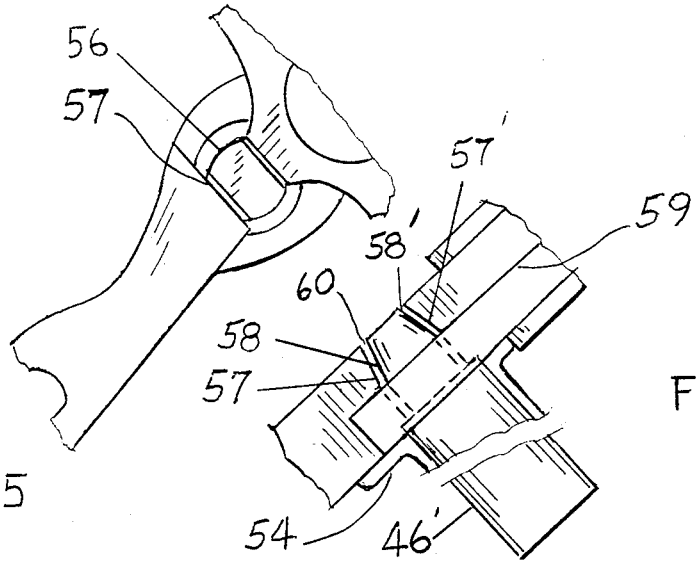
Fig. 24
Fig. 25

HOIST CABLE COUPLING DEVICE (FOR SUSPENDED LOADS)

BACKGROUND OF THE INVENTION

In the past, somewhat complex hooks and couplings have been used to suspend cargo for the purpose of transporting it from one site to another and then remotely and/or automatically unloading such cargo. The cargo may be deposited on a platform, whether it be a ship-at-sea or a truck on land, by decoupling it at the desired site, preferrably with no personnel at the site to disengage the load.

Single-point operation has been preferred over multi-point (or multi-coupling) operation, particularly for externally-slung helicopter loads. However, two-point operation would provide greater load stability,—because of less twisting and swaying of the load. In manual decoupling of loads, it is obvious that more time would be consumed and required to disengage two coupling devices than one device, unless both devices were uncoupled simultaneously by a remote means. One also should bear in mind that each coupling device may have appreciable weight, another factor to consider when deciding how many couplings to use.

A coupling device should provide safety and economy in making such loadings and unloadings with ease in positioning and releasing the suspended load at the desired site.

The Boeing heavy lift helicopter (Vol. II s 301-10000-2 of Oct. 31, 1973, Contract DAAJ01-71-C-0840 (P40)), states that hook-up time at a prepared site is to be performed in no more than two (2) minutes. To meet this time requirement, a cable, separate from the hoist tension cables, attached directly to each coupling, deployed from a separately-powered cable reel, mounted adjacent to the main hoists, was recommended by Boeing-Vertol. The cable would carry conductors for mechanizing a remote mechanical hook release system, to run from the coupling at the load to the crew station within the aircraft.

The device suggested here would be simpler in construction than the Boeing hook mechanism. Also, the need for skilled personnel at the loading site to remove cargo could be unnecessary. Just any laborer could remove cargo, should ground personnel be required.

SUMMARY OF THE INVENTION

The present invention describes a novel coupling device, which can be decoupled quickly with few, if any, ground personnel. Avoiding the presence of ground (unloading) personnel is particularly desirable when helicopters are used to suspend cargo, because of the rotor down draft and other dangers from being beneath a hovering aircraft. In situations wherein the loading platform is not stationary, as in a ship at sea, the unloading task could be more difficult and hazardous.

In the techniques described here, the coupling device may be decoupled at the loading site either remotely or manually by personnel at the load site by simply pulling a cord attached to a magnetic part. The doughnut-shaped part has hoist cables attached to it for suspending the coupling device, while the scissor-like part has handles with holes for attachment of load cables for suspending the cargo. The magnetic part is placed in the crevice between the midsection of the one scissor-like half and the handle portion of the other half, as in a scissors.

When one pulls on an attached cord, the magnet, having flat parallel sides, easily slides along the polished surfaces of the recess or crevice including its polished parallel sides. Upon removal of the magnet, the blades of the scissor-like part collapse together, due to its weight, and the collapsed blades slip through the doughnut-shaped part's central hole, disengaging the coupling.

For a weak magnet, the magnetic part is tapered at its lower portion and the sides of the crevice or recess are accordingly tapered to prevent the magnet from being pulled out perpendicularly to the blade's surface or face of the scissor-like part, when the magnet is in place.

BRIEF DESCRIPTION OF THE DRAWINGS

For the purpose of illustrating the invention, there are shown in the drawings a form there-of which is presently preferred. It is understood, however, that this invention is not necessarily limited to the precise arrangement, instrumentalities and field of utility as therein demonstrated.

FIG. 11 is a side view of one solenoid and circuit diagram of two stitches, each capable of activating the solenoid. One switch is at the load location and the other at the overhead hoist reel location.

FIG. 12 is a side view of the doughnut shaped part, showing a large central hole, reduced in size from that shown in FIG. 2.

FIG. 13 is its front or top view.

FIG. 16A is a side view of the magnetic part showing the tapered portion and indicating that the part is a composition of magnetic and nonmagnetic materials.

FIG. 16B is an end view thereof.

FIG. 17 is a side view of the scissor-like part, showing a side view of the tapered recess for receiving the magnetic part.

FIG. 18 is a front view thereof.

FIG. 19 is a partial side view of the postion of the scissor-like part showing the tapered recess for receiving the magnetic part, shown in FIG. 16A.

FIG. 22 is a side view of the scissor-like part showing a solenoid attached near the part's midsection.

FIG. 23 is a front view of the scissor-like part in its spreadapart position, showing the solenoid's plunger extended to keep the scissor-like-part handles apart. The doughnut-shaped part is shown in dashed lines to avoid over-crowding the assembly drawing.

FIG. 24 is a partial side view, showing the solenoid's plunger with tapered upper portion. In FIG. 23, the plunger is not tapered.

FIG. 25 is a front partial view thereof.

DESCRIPTION OF THE PREFERRED EMBODIMENT

Figure 1:
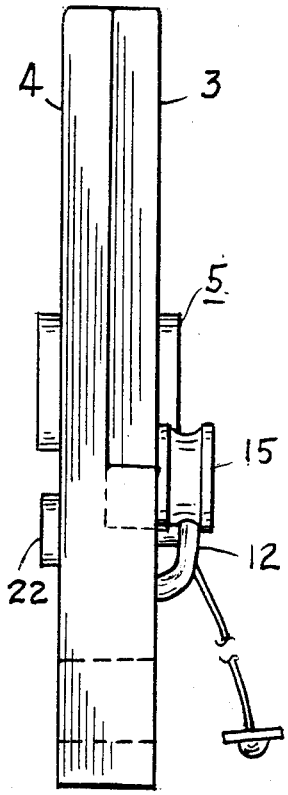
FIG. 1 is a side view of a cargo coupling device for safely unloading suspended loads, showing a side view of the scissor-like part of the device.
Figure 2:
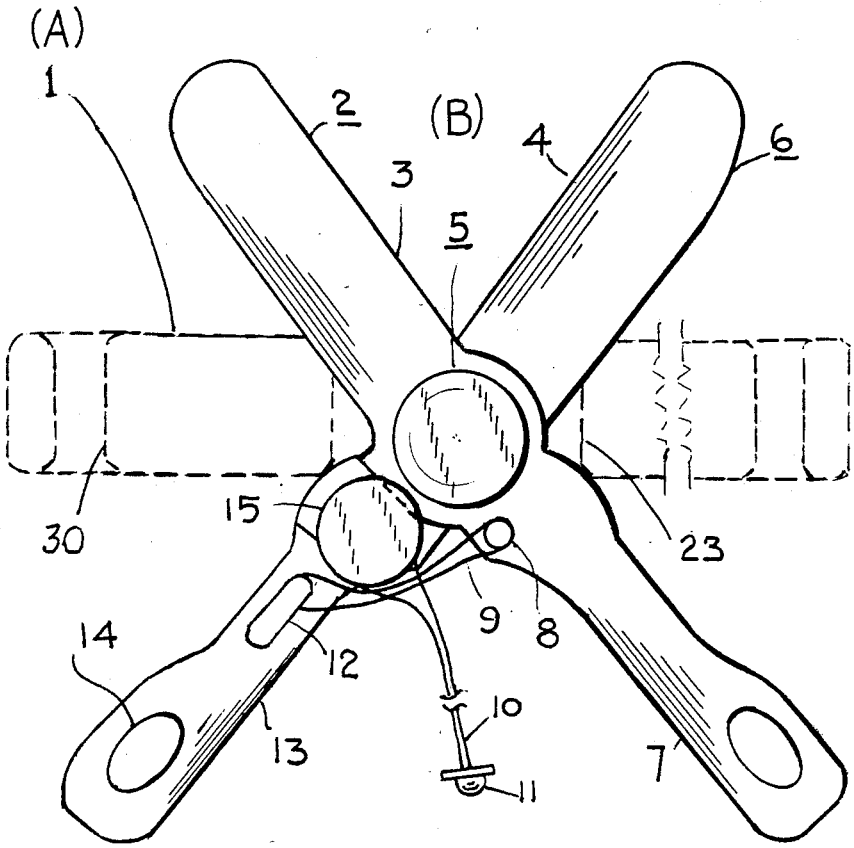
FIG. 2 is a front view of the assembled coupling device, showing the scissor-like part, the doughnut-shaped part and the magnetic part. The blades of the scissor-like part are shown apart or in open position with the magnetic part inserted between the blades locking them in the open position.

An embodiment of a hoist cable structural coupling device is portrayed in the assembly views of FIGS. 1 and 2. The overhead hoist cables and the load cables below the coupling device are not shown, as they would be standard off-the-shelf items, including steel shackles, rings and wire ropes and fittings. The holes 14 in the handles 7 and 13 of FIG. 2 could be modified to suit the fitting used. Similarly, holes 30 on doughnut-shaped part 1, FIG. 2 could be modified to suit the selected fitting.

The coupling device itself, shown engaged in FIG. 2, is designed with provisions so it can be uncoupled remotely, either from below the device of from above the device by pulling on a cord attached to a magnetic part 15, FIGS. 1 and 2. The device's scissor-like part 2 is designated as part B, while its doughnut-shaped part 1 is designated as part A, and magnetic part 15, designated as part C. Part C is positioned in the recess between handles 7 and 13 of part B, to prevent part B from collapsing. A collapse would mean the coming together of blades 3 and 4 of part B, allowing part B to slip through hole 23 of part A, FIG. 13. Magnetic part B, FIG. 2, is inserted in recess 28, between sides 26 and 27, FIG. 14.

Figure 5:
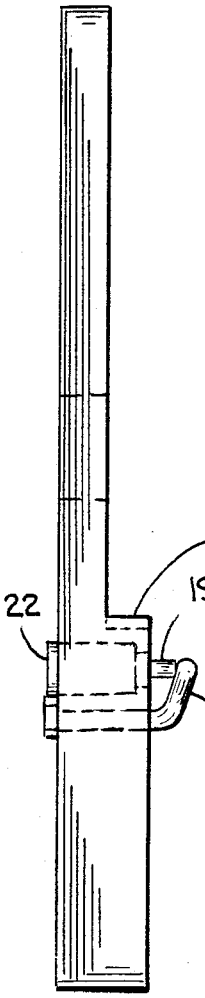
FIG. 5 is a side view of one-half of the scissor-like part showing its blade and its handle portions.
Figure 6:
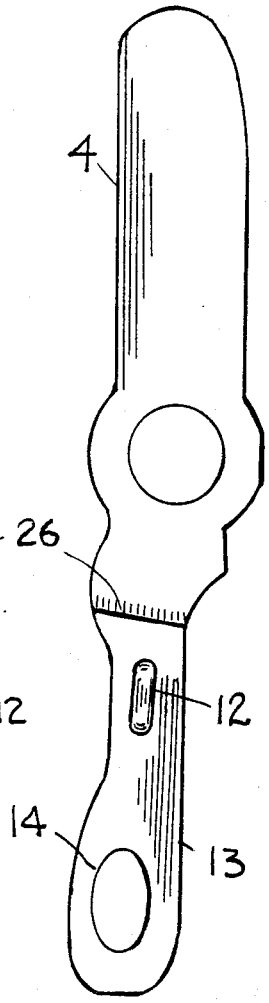
FIG. 6 is its front view, showing a large hole midway for the pivot pin and another hole at its handle portion.
Figure 7:
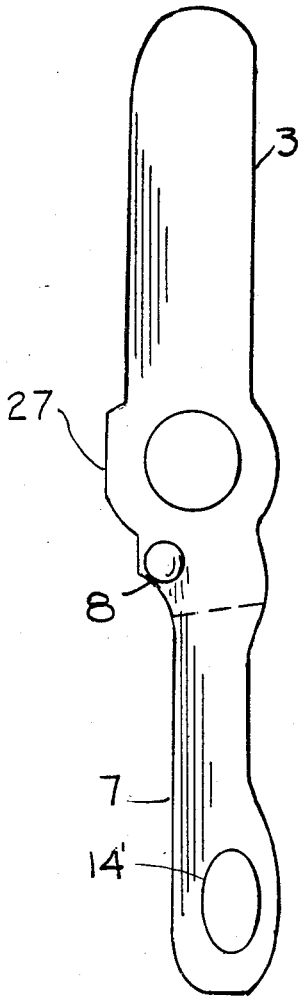
FIG. 7 is a front view of the other half of the scissor-like part showing similar holes as in FIG. 6.
Figure 8:
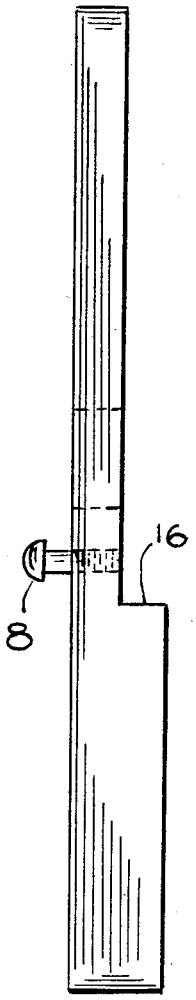
FIG. 8 is its side view, showing the lower part twice as thick as its upper part.
Figure 9:
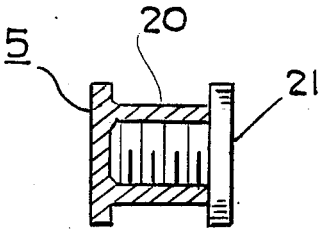
FIG. 9 is a side sectional view of the pin about which the two halves of the scissor-like part pivot. The pin is shown to consist of two parts,—a screw portion and a portion with an internal screw thread for the screw portion to screw into.
Figure 10:
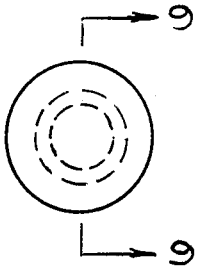
FIG. 10 is a front view of the pin.

Scissorlike halves 7 and 13 are shown separately in FIGS. 7 and 6, respectively. Their side views are shown in FIGS. 8 and 5, respectively. Magnetic part 15 is shown in detail in FIGS. 3 4, while doughnut-shaped part 1 is shown in detail in FIGS. 12 and 13, FIG. 12 being a cross-sectional view along line 12—12 of FIG. 13. Part A in FIG. 13 shows four equally-spaced ears 29, and large central hole 23 and line 42. Hoist cables are attached to equally-spaced holes 30 shown in FIGS. 2 and 13, while load cables are attached to holes 14 and 14′ in part B, FIGS. 2, 6 and 7. Blades 3 and 4, part B, are inserted into central hole 23, part A, in their collapsed or closed form; then blades 3 and 4 are opened and finally magnetic part C is inserted in recess 28, FIG. 14, as shown in assembly, FIG. 2. As depicted in FIG. 2, handles 7 and 13 extend downwardly while blades 3 and 4 extend upwardly. However, the coupling assembly of FIG. 2 could be used in either an upward or downward position.

In other words, the coupling device, shown in FIG. 2, maybe used upside down and function equally well, in which case the load cables would be attached to holes 30 of part A, FIG. 13. For additional safety, a second magnetic part could be inserted in the recess on the reverse side of scissor-like part B, with a cord attached to it for removal.

Figure 14:
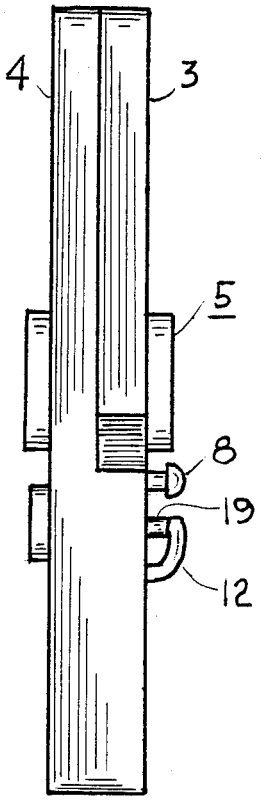
FIG. 14 is a side view of the scissor-like part of the coupling, and showing the recess for receiving the magnetic part.

Parts A and B are shown engaged as in FIG. 2, when part B rests snugly inside central hole 23, FIGS. 2 and 13, at part B's midsection, then magnetic part C is inserted in recess 28, FIG. 14. Part C prevents the collapse or closing together of blades 3 and 4, part B, FIG. 2, under load conditions, when handles 7 and 13 are supporting cargo via load cables. Magnetic part C prevents both the collapse of part B and the separation of part A from part B.

In FIG. 14, side surfaces 26 and 27 and bottom surface 3 are flat and polished. In addition surfaces 26 and 27 are parallel to each other. Thus, magnetic part 15 can be slid off from the above polished surfaces with little effort, by means of cord 10 attached to groove 16, FIG. 3, but part 15 cannot be easily removed perpendicularly to its bottom surface 31, FIG. 14, when part 15's magnetic field is sufficiently great.

In order to avoid the accidental possibility of pulling cord 10, parallel to sides 26 and 27, FIG. 14, and removing magnetic part 15, a restraining cord 9 is stretched between pin 8 and solenoid plunger 19, FIGS. 5 and 8, to prevent removal of part C (15) even when cord 10 is pulled. Restraining cord 9 straddles groove 16 of part 15, to prevent the accidental removal of part 15. However, if part 15 needs to be removed, solenoid 22 is energized, causing plunger 19 to recede, allowing the end of cord 9 around polished plunger 19 to be free of plunger 19, thus not obstructing the removal of magnetic part 15.

To assist the operator of the suspended cargo, it would be helpful to have a light-emitting diode turn "on" when plunger 19 of solenoid 22 is energized, visible to the operator, as shown in FIG. 11, to inform him that plunger 19 has pulled-in. Diode (LED) 32, located visibly on handle 13, scissor-like part B, is shown in series with resistor 33. The two electrical components, 32 and 33, are in parallel with the circuit of solenoid 22, so that when solenoid 22 is energized, LED 32 is turned on, indicating that plunger 19 is in a receded position. Pull-in type linear solenoids are manufactured by various domestic and foreign firms, including Ledex, Vandalia, Ohio 45377.

To energize solenoid 22 mounted on handles 13, FIGS. 5 and 11, either SPDT switch 11 or switch 25 may be operated manually. a voltage supply E would be included in the circuit to energize the circuit, FIG. 11. Switch 11 could be located at or near the coupling device shown in FIG. 2, while switch 25 could be located at the location of the hoist cable reel above, whether it be at the cockpit of a helicopter or at a derrick cabin.

Figure 3:
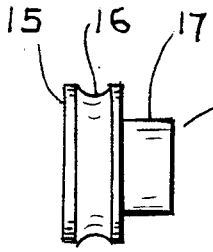
FIG. 3 is a side view of the magnetic part.
Figure 4:
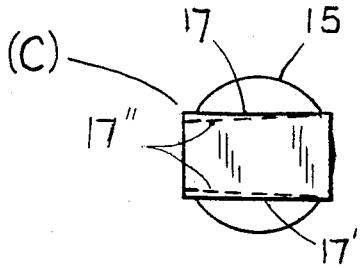
FIG. 4 is its bottom view with dashed lines to indicate tapering.
Figure 15:
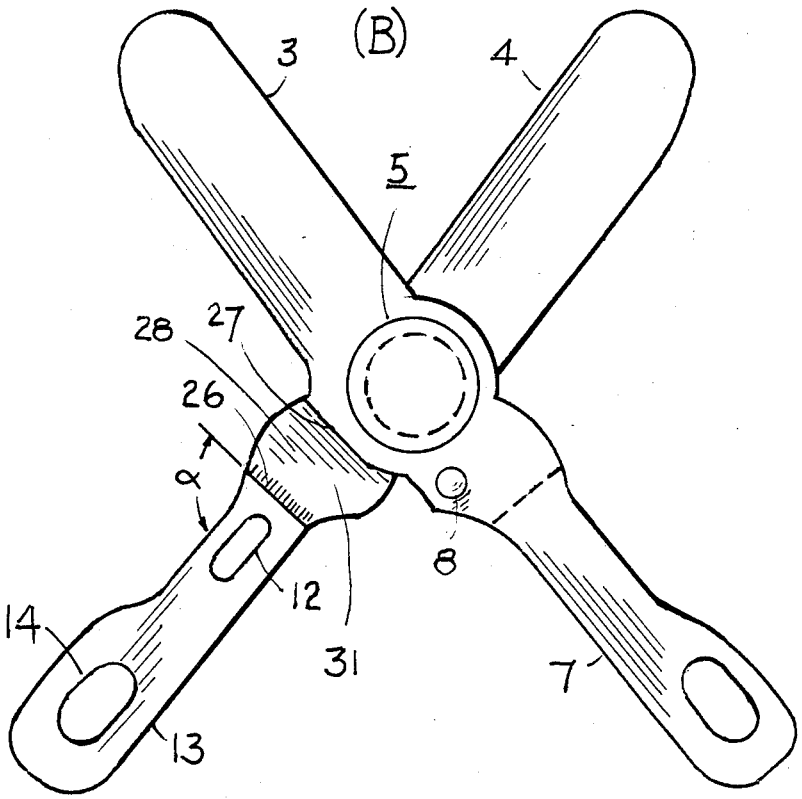
FIG. 15 is a front view thereof.

In cases where a permanent magnetic part C with less field strength is desirable, portion 17, FIGS. 3 and 4, may be slightly tapered, as indicated by numeral 34, part 35, FIGS. 15 and 16. The remainder of magnetic part C would remain the same as in part 15, FIG. 3. A revised drawing of FIG. 14, shows the tapered sides 26' and 27' in FIG. 17. The tapered sides of both the magnetic part 35 and sides 26' and 27' of part B, FIG. 17, are polished to enable easy removal of tapered magnetic part C. The tapering of sides of part 35 and of sides 26' and 27' part B, FIG. 18, would prevent part 35 from being pulled out perpendicularly to part B's front face, FIGS. 2 and 18. FIG. 17 is a side view of FIG. 18, while FIG. 19 is a partial side view from another direction to show recess 28'. However, as before, part 35 can be pulled out sideways by cord 10, perhaps even more easily than before; easier with the tapered sides 34, since the magnetic field strength would now be less. Therefore, there also would be greater need to have restraining cord 9, than before, for safety reasons. However, its magnetic field strength need not be less.

It should be mentioned here that magnetic part C, FIG. 16A, may be a composition of non-magnetic stainless steel 36 and ALNICO or rare earth cobalt magnet 37. Such a composition could withstand compressive stresses better than a part C, being solely of magnetic metal, since stainless steel can have a very high compressive strength. Side view of part C is shown in FIG. 16B.

Scissorlike part B is designed to allow it to enter hole 23 of part A in either the blade direction first or the handle direction first.

Figure 20:
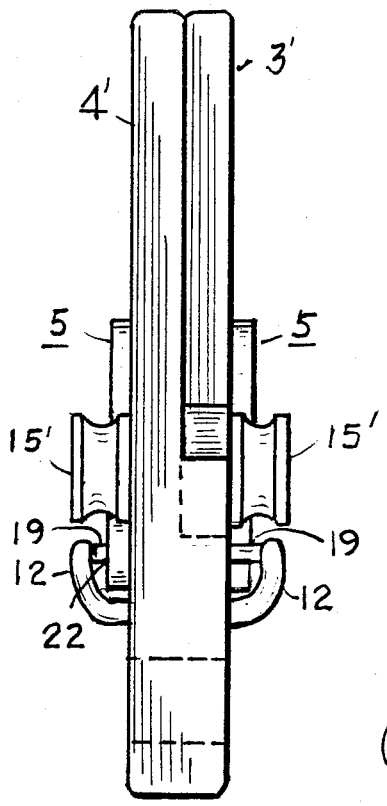
FIG. 20 is a side view of the scissor-like part showing two magnetic parts, one placed in each of two opposite-side recesses of the scissor-like part, when in open position with its blades separated.
Figure 21:
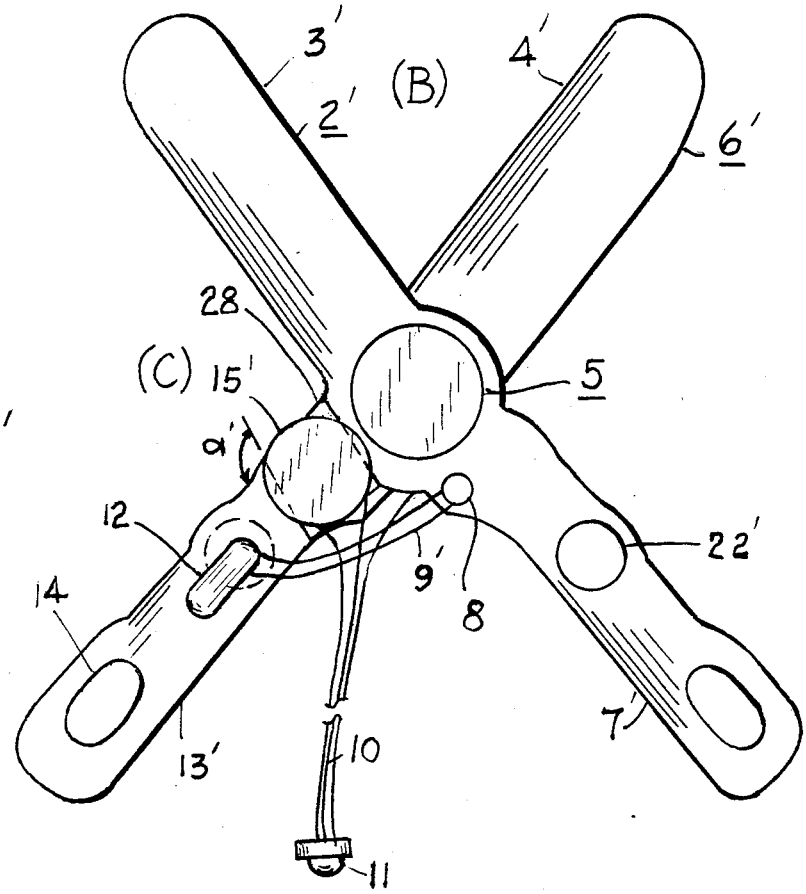
FIG. 21 is a front view of assembled coupling device, showing the scissor-like part and two magnetic parts with the blades spread but without the doughnut-shaped part. Two magnetic parts are shown, one on each opposing side, for added strength in keeping the blades apart.

If one observes and examines a scissors, one will find two identical recesses existing near its pivoted section, one on either opposite side. Each of the two recesses is capable of accommodating magnetic part C. FIG. 20, a side view, shows magnetic parts 15' being held in place in recess 28' on either side of scissor-like part C. Notice that the recess angle $\alpha'$ FIG. 21 is greater than angle $\alpha$ of FIG. 15. This is to indicate that the angle that sides 26 and 27 make with the side of handle 13, FIG. 15, can vary to make it easier for it to be pulled out by cord 10 by a person on the ground or platform. If two magnetic parts 15' are employed, both for added safety and for greater load capability, then two solenoids 22 and 22', one installed in either handle, 7' and 13', would be desirable, if a restraining cord 9' is to be used to prevent removal of magnetic part 15'. When both solenoids, 22 and 22, are energized by pressing switch 11, plungers 19 retract and allow that end of cord 9' to fall free, enabling the removal of magnetic parts 15, by pulling on cord 10. Cord 10 would be tied to both magnets. To make it easier to remove magnets 15', sides 26 and 27, FIG. 15, and bottom surface 28 could be lubricated. The same size magnet, shown in FIGS. 3 and 4, may be used in the recesses 28 of FIG. 21.

Red colored light-emitting-diodes (LED) 32, in series with resistance R, are shown or indicated in FIGS. 11 and 2. When unloading cargo, it helps the operator of the unloading system to know that when either switch 11 or switch 25 is turned ON, that solenoid 22 has truly been energized, by observing the illumination of an LED 32 mounted on scissor-like part B, FIGS. 1 and 2. As shown in FIG. 11, both LEDs 32 are connected in parallel with the coil of solenoid 22. Two or more LEDs, mounted on various sides of the sicssorlike part, are desirable so that the operator will have no difficulty observing the condition of an LED. Holes would be provided in handles 7 and 13 of the scissor-like part for mounting of the LEDs. Each LED would be connected across the two wires 40 emerging from solenoid 22, FIG. 11, so that when a solenoid is energized, the LEDs are illuminated.

In FIG. 13 line 42 is merely a line on the surface of 1 to aid the fabricator of this irregular part A.

In the previous schemes, a magnetic part was used to lock the scissor-like part in place when engaged and coupled with the doughnut-shaped part. In this technique, a restraining cord straddles across the magnetic part as a safety precaution to prevent the possible accidental removal of the magnetic part by one's pulling on cord 10, FIG. 2.

In a slightly revised design of the scissor-like and magnetic parts, a plunger of a solenoid is substituted for the magnetic part 15, FIG. 2. In this revised design, restraining cord 9 would be unnecessary because the plunger is attached to the solenoid, which itself is firmly fastened to scissor-like part 48. Solenoid 46 in FIGS. 22 and 23 is of the pull type and attached to one of the handle portions of scissor-like part 48. "Pull type" means that plunger 45 is normally extended and designed to retract, as much as $\frac{3}{4}''$, when energy is applied to the solenoid coil, thus allowing handles 43, 44 and blades 41, 42 of the scissor-like part to come together or collapse when plunger 45 retracts to position identified by numeral 59, FIG. 24, and scissor-like part 48 looks like that shown in FIG. 26 in its completely collapsed condition. It should be mentioned that in FIG. 23 sides of both plunger 45 and side walls 50 and 51 are vertical, not tapered, as in FIG. 24. When the two parts A and B uncouple, the load which the hoist cable supports is freed from the remainder of the hoisting mechanism, so that it remains on the landing platform. Both parts A and B of the coupling device may now be used for the next task of loading and transporting cargo from one site to another.

The shape of handle 43, FIG. 23, has been redesigned to allow sufficient width at the plunger 45 location for installation of solenoid 46. As in FIG. 15, sides 50 and 51, near midsection of part 48, FIG. 23, are parallel to each other. Opposite flat sides of plunger 45 also are parallel to each other, even as sides 17 and 17' of magnet 15, FIG. 4, are parallel to each other. Also plunger 45, FIG. 23, may be prevented from rotating by a shroud below line 42', FIG. 22, surrounding the flat surfaces 50 and 51 of plunger 45. Both the exterior of plunger 45 and sides 50 and 51 of part 48 are very smooth and lubricated so that plunger 45 may extend and retract with ease, particularly under unloaded conditions; that is, when the suspended load is resting on a loading platform. However, when the load or cargo is suspended in midair and there is a need to uncouple the device shown in FIG. 23, such as during an emergency, it may be possible to cause plunger 45 to retract in midair if plunger 45 and part 48 are designed for that emergency situation. Such a design is shown in FIGS. 24 and 25.

Electrical cord 52 in concert with a power source and switch 53 form a circuit similar to circuit shown in FIG. 11, to enable an operator of the hoisting mechanism to disengage the suspended load by energizing the solenoid 46.

Bracket 54 helps support solenoid 46. Other such brackets could surround the solenoid's exterior cylindrical surface. In addition, the solenoid could be cemented in position.

It should be mentioned that plunger's exterior 46 is high strength stainless steel and that flat surfaces 50 and 51, in contact with plunger 45 also are high strength stainles steel.

In assembly drawing, FIG. 23, the doughnut-shaped part 49 is shown in dashed lines to avoid crowdedness and assist in the clarity of part 48's design. Part 49's shape is identical to the shape of the part shown in FIGS. 12 and 13 except for the shape of central hole 23, which would conform to the exterior shape of scissor-like part 48, as shown in FIG. 23.

In emergency situations when cargo must be unloaded in midair, scissor-like part 48 would have a slightly differently designed plunger 56, shown in FIGS. 24 and 25, to more easily disengage the load while suspended in midair. Plunger 56 is shown with opposing sides 58 and 58' slightly tapered. Opposing sides 57 and 57' of the cavity also are tapered to correspond with those of the plunger. Actually no space exists between side 57 of scissor-like part and side 58 of plunger 56. The same is true of sides 57' and 58'. FIGS. 24 and 25 are partial views in the area of the solenoid 46 of FIGS. 22 and 23. The only alteration or change in FIGS. 24 and 25 from FIGS. 14, and 15 is the tapering of opposing sides 58 and 58' of plunger 56 and the tapering of corresponding sides of the cavity or recess within which plunger 56 moves, when energized. The above sides 57 and 58, 57' and 58' are smooth and well lubricated, so that when energy is applied to solenoid 46', plunger 56 will recede into solenoid 46 the specified amount, with the slight tapering of plunger 56 providing assistance in the retracting motion, even under suspended load conditions.

It should be mentioned here that in magnetic part, FIG. 4, sides 17 and 17' of magnet could be slightly tapered as shown in dashed lines 17'' to enable magnetic part be removed more easily, with a suspended load should an emergency arise. The wider portion of the taper would occur at the inside of scissor-like part in the direction of pull cord 10.

Figure 26:
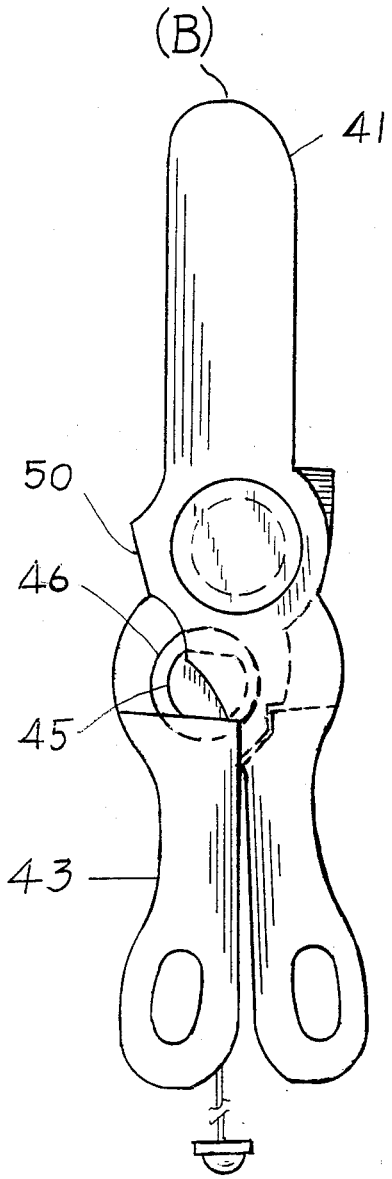
FIG. 26 is a front view of the scissor-like part, shown in FIG. 23, with its blades in the closed position and with the solenoid's plunger retracted, so that the part's blades can come together.
Figure 27:
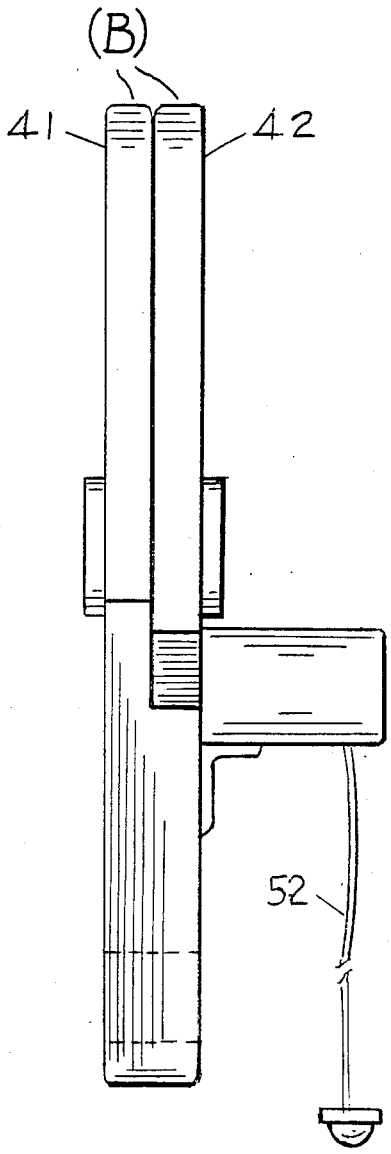
FIG. 27 is a side view thereof.

When blades 41 and 42 of the scissor-like part 48 are in closed position, the part looks like FIG. 26. Its side view is shown in FIG. 27.

An elastic membrane may be placed over the solenoid's plunger 45 area in order to keep that area clean in duty and polluted environments. The membrane could extend to include pivot pin 5 area. The backside of pin 5 could have a membrane stretched over it, too, to keep out dust and dirt, as well as fungi.

To summerize the advantages of this simplified design of a hoist cable coupling device, shown in FIG. 23, the following features should be noted:

1. The assembly consists of very few parts and are uncomplicated to fabricate;
2. No springs, susceptible to breakage and perhaps needing periodic adjustment;
3. No skill required to couple or uncouple the device from the load, in so far as the coupling device itself is concerned;
4. No unbalanced torque, with weight equal to that of solenoid added to handle 44, to contend with when supporting a load, should that be a problem;
5. Not bulky;
6. Capable of supporting heavy loads reliably;
7. Can be used in multiple units to lift heavy loads;
8. Capable of being used upside down or horizontally, without impairment in its performance as a coupling device;
9. Capable of being protected from fungi, dust, dirt, corrosion;
10. Lends ltself to easy inspection, since parts are few easily accessible for inspection;
11. Uncomplicated for a strength of materials expert to calculate stresses in the materials used, which can be high strength stainless steel or even aluminum alloy in some portions;
12. No permanent magnets required;
13. Uncouples easily when solenoid 46 is energized;
14. Only one part is capable of rotating,—the pivot pin 5. Only one part, plunger 45, is capable of linear motion;
15. Low cost to produce in quantity;
16. No limitation in regard to cone angle of suspended load cables, emergimg below the couping device Parts A and B can be designed to accept either the magnetic part or the solenoid, whichever locking method is preferred, since both parts are located in the same area, provided the surfaces in contact by the magnetic part are magnetically attractable.

Hooks or other type fittings are attached to the load or cargo itself. When load cables are removed from the cargo and the above coupling device is recoupled after being uncoupled, the entire hoisting apparatus, including the coupling device, can be hoisted up by the hoisting mechanism to be reused elsewhere.

If there is any question in regard to the permanent magnet's possible loss of strength, its strength can be measured with a gaussmeter to determine if there is any loss before applying the magnetic part to the coupling device.

The amount of taper or slope of plunger, shown in FIG. 24, will influence the effort by the solenolid to retract or recede or pull in when energy is applied to the solenoid. Under loaded conditions the heavier the load suspended, the greater must be the plunger's taper, to a limit. There is a limit as to how much taper, as determined by stress analysis calculations for the material used.

Figure 32:
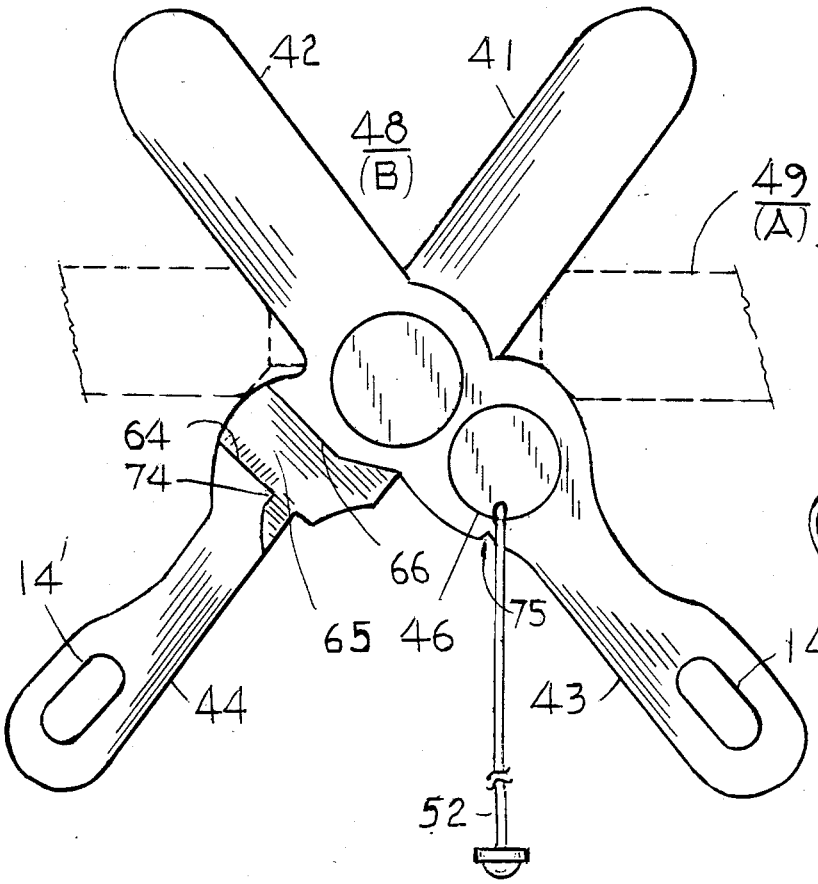
FIG. 32 is a rear view of scissor-like part shown in FIG. 23, showing a second recess for installation of a magnetic part, in addition to plunger recess shown on front side, FIG. 23, to help keep blades of scissor-like part spread apart.

To avoid conjecture regarding the design of the coupling device shown in FIG. 23, the rear side of FIG. 23 is shown in FIG. 32. Note that on this reverse side, FIG. 32, a cavity or recess 65 is shown with parallel straight sides 64 and 66. Its purpose is to provide a recess for placement of a magnetic part, such as shown in FIGS. 3 and 4, to enable a user to have a choice of using either solenoid plunger 45, FIG. 23, or magnetic part 15, FIG. 3, to lock scissor-like part 48 in an open position with blades 41 and 42 spread apart as shown in FIG. 23. For example should solenoid 46 be inoperable, it can be removed and a magnetic part, such as shown in 35, FIGS. 15 and 16, can be substituted. Also, for certain suspended heavy loads in wind gusty weather, both solenoid plunger 45, FIG. 23, and a magnetic part, such as shown in FIGS. 3 and 4, may be applied to scissor-like part 48 in order to provide greater load carrying strength to the assembled and engaged coupling device.

Figure 28:
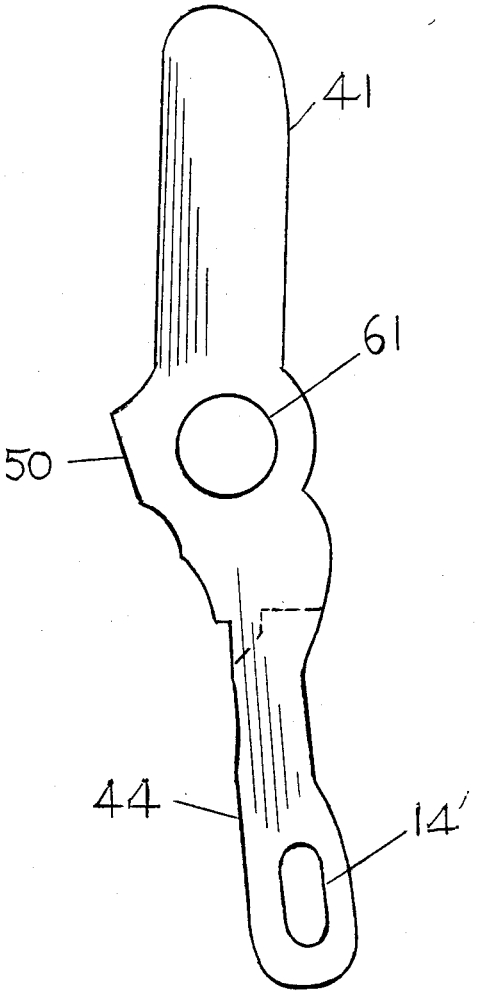
FIG. 28 is a front view of one-half of scissor-like part shown in FIG. 23.
Figure 29:
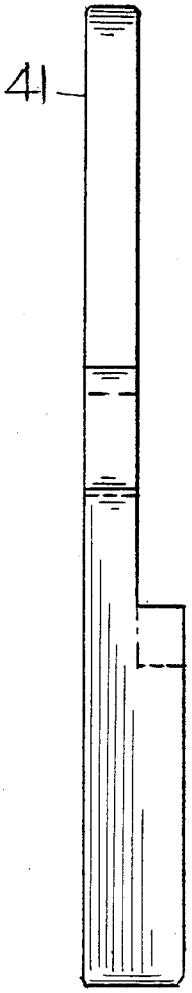
FIG. 29 is a side view thereof.
Figure 30:
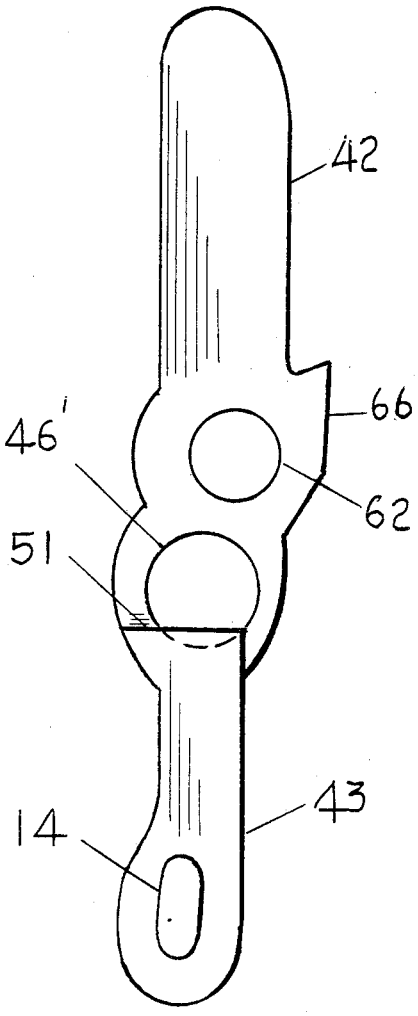
FIG. 30 is a front view of the other half of scissor-like part shown in FIG. 23.
Figure 31:
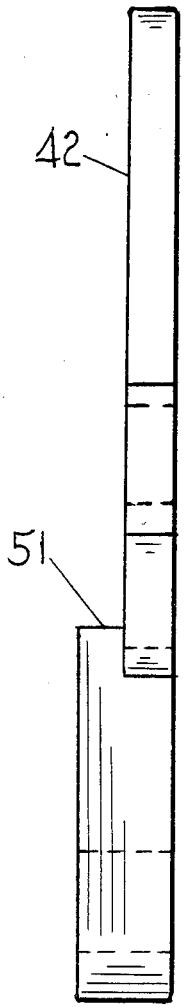
FIG. 31 is a side view thereof.

Views in FIGS. 28 and 29 are provided to show the shape of one of the halves of scissor-like part 48, including the shape of handle portion 44. FIGS. 30 and 31 are provided to show the shape of the other half of scissor-like part 48, including shapes of portions 66 and handle 43. Hole 46' is provided for installation of solenoid 46.

Figure 33:
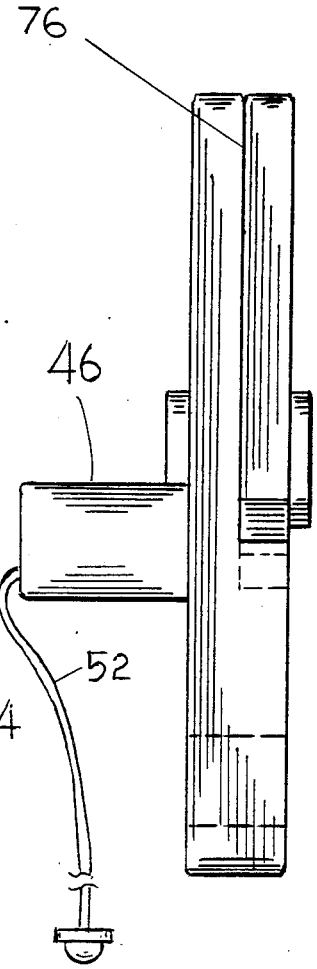
FIG. 33 is a side view thereof.

In order not to leave any portion of the scissor-like part B of FIG. 23 to conjecture, its back view is shown in FIG. 32. FIG. 32 shows a second recess 65 having vertical parallel sides 64 and 66. The location of the back end of solenoid 46 is shown. The angle between handles 43 and 44 is approximately 90°, but this angle could be less or more, as required for the cargo handling application. This coupling could be used by NASA for space applications, since it can be used in any attitude, including upside down. FIG. 33 is a side view of FIG. 32, showing solenoid 46, which could be a modified LEDEX pull solenoid, with an appropriate stroke. LEDEX, Inc., is located in Vandalia, Ohio 45377.

Figure 34:
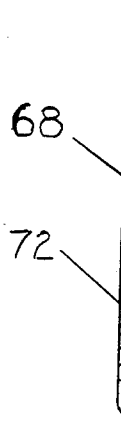
FIG. 34 is a side sectional view of a rectangular doughnut-shaped part along line 34—34, FIG. 35, reduced in size.
Figure 35:
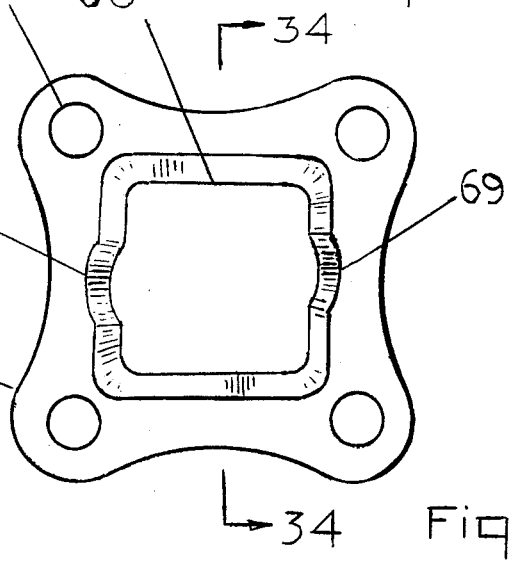
FIG. 35 is a top-plan view of the rectangular doughnut-shaped part of FIG. 34, showing a rectangular-shaped central hole, reduced in size from that shown in FIG. 32, in dashed lines.

In order to allow more room for solenoid 46 of scissor-like part B, a rectangular doughnut-shaped part A is suggested and shown in FIGS. 34 and 35. FIG. 35 is a top/plan view of the rectangular-shaped part, showing rectangular hole 68 and indentations 69. Indentations 69 are provided to accommodate the contours of the backs of blades 41 and 42. Although indentations 69 are not shown off-center with respect to the hole's length, it is suggested that they be located a little off-center in order to provide more clearance for the cylinder of solenoid 46. FIG. 34 is a sectional side view of FIG. 35 along line 34—34. Indentaion 69 also is shown in this view. Four holes 71 are for hoist cable attachment. Bevel 72 is shaped to accommodate the upper portion of handles 43 and 44 to rest against, while indentations 69 are shaped for blades 41 and 42 to rest against. It should be noted that indentations 69, on opposite sides of rectangular hole 68 are slightly off center to accommodate blades 41 and 42 which, when spread apart, are off center by the thickness of each blade, the center being line 76, FIG. 33.

In FIG. 32, projection 74 fits into recess 75 of handle 43, when handles 43 and 44 come together as in FIG. 26. Projection 74 provides additional surface to side 64 of recess 65.

Figure 36:
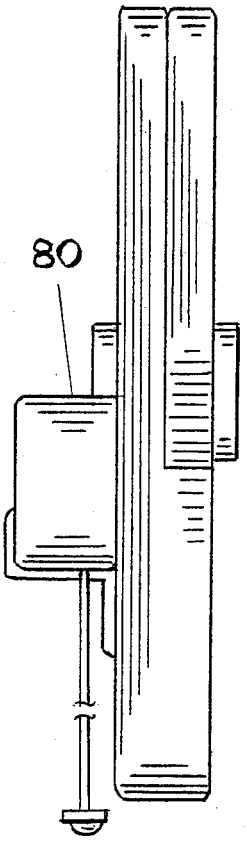
FIG. 36 is a side view of the scissor-like part showing a rotary-type solenoid near the part's mid-section.
Figure 37:
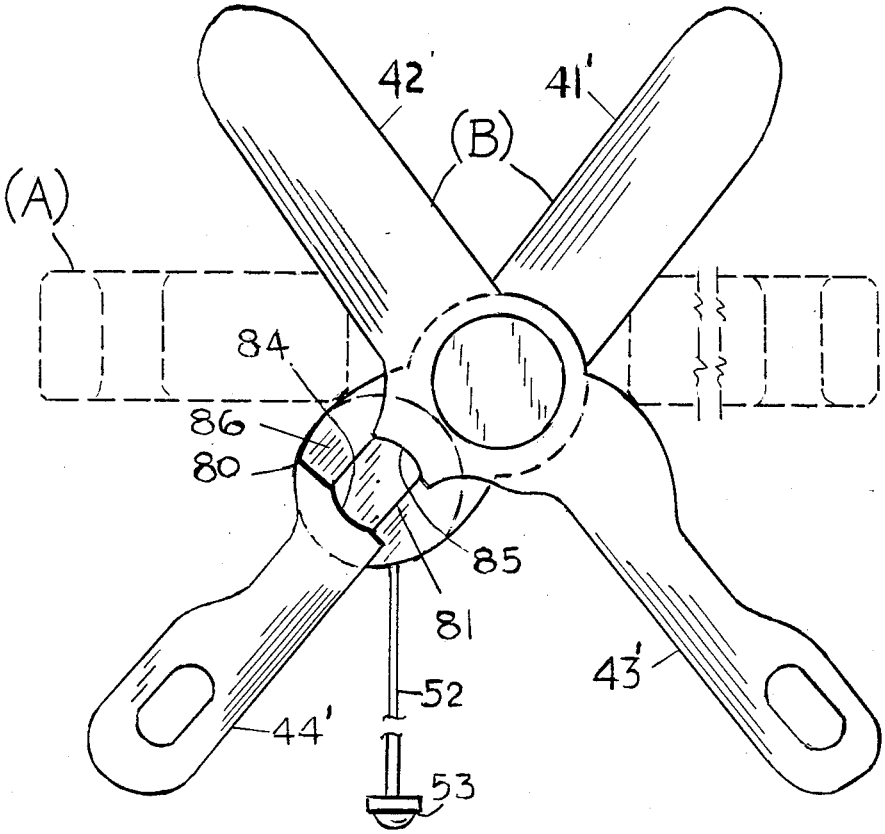
FIG. 37 is a front view of the scissor-like part in its spread apart position, showing a solenoid with its shaft's rectangular attachment protruding at the location of the recess, mentioned in description of FIG. 14. A rectangular-shaped part with a central hole, shown in FIG. 35, for engagement with the scissor-like part, is shown in dashed lines to avoid over-crowding the drawing.
Figure 38:
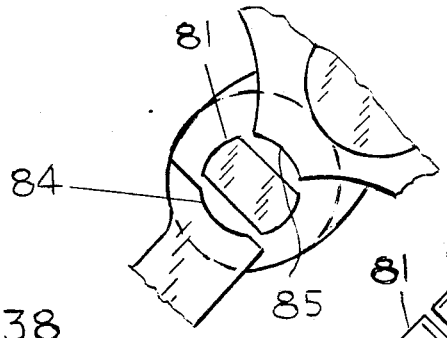
FIG. 38 is a partial front view, near the scissor-like part's mid-section, showing the solenoid's rectangular attachment in an open position, rotated 90° under voltage excitation, to permit the coming-together of the blades and handles of the scissor-like part.

Another version of the design shown in FIGS. 22 and 23 is shown in FIGS. 36 and 37. In this design a rotary solenoid 80 is incorporated in one handle portion 44' of scissor-like part B, instead of a linear pull-type solenoid 46. Solenoid 80 has an attachment 81 to its shaft 82. Attachment 81 is rectangular-shaped with convex curved opposite ends, which fit snugly into corresponding concave recesses at 84 of handle 44' and at 85, between handle 42' and blade 43'.

Figure 39:
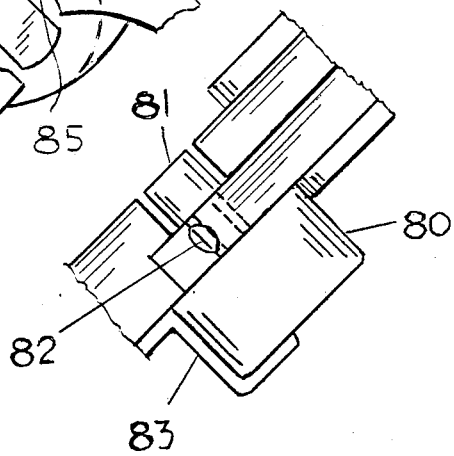
FIG. 39 is a side view thereof. The attachment is rigidly fastened to the solenoid's shaft.

When attachment 81 is in the position shown in FIG. 37, scissor-like part B is locked in the position shown, considered the unenergized solenoid position. When the solenoid is energized via momentarily pressing switch button 53, attachment 81 rotates 90° to the position shown in FIGS. 36 and 39. In the latter position of 81, hndles 43' and 44', under either load or no-load condition, will come together; in so doing, the coupling device is disengaged.

Except for rotary solenoid 80 and the size of recess 86, the construction of the remainder of scissor-like part B is essentially the same as that shown in FIG. 23. Hence, there would be no need to make detail drawings of the two halves of the scissor-like part, such as shown in FIGS. 28 and 30; nor would there be reason for providing a back or rear view, such as shown in FIG. 32. The back side of FIG. 37 would look essentially the same as that of FIG. 32 with the same size recess 65.

As a final note, solenoids such as shown in FIGS. 32 and 37, are manufactured by several firms, such as LEDEX, Inc., Guardian Solenoids, Chicago, Ill., Deltrol Corp., Wisconsin. In one type, the solenoid might have a threaded portion at the plunger end, in which case, the solenoid would be screwed into the handle portion of the scissor-like part's handle. In another solenoid, the item might have threaded machine screws projecting from either the front or rear of its cylindrical case. The handle 44 or 44' would have provision for receiving the screws for firmly fastening the solenoid to the appropriate handle of part B.

The other item has to do with the matter of the voltage supply. The supply could come from electrical wiring incorporated within the hoist or load cables, with the understanding that this coupling device has the capability of being used upside down. If a battery is used as the voltage source, then it may be possible to incorporate a rechargeable Ni-Cd or lithium high energy density battery within an enlarged casing or on the solenoid casing's exterior. A suggested battery and solenolid could be: 6-volt GE BB505 Ni-Cd battery and Guardian long life tubular DC solenoid No. LT-8X9 for intermittent operation.

The latter design with a rotary solenoid may be used as an educational toy for 8 years and older children, as well as for military and nonmilitary applications. The toy could be fabricated of plastic materials and used for toy towing trucks and for construction of minature bridges and miniature buildings made of cinder blocks.

I claim:

1. A hoist cable coupling device for quickly releasing suspended cargo, comprising an doughnut-shaped part A, an independent scissor-like part B and a magnetic part C, all for use with hoist and load cables, both said cables being adapted for attachment to parts A and B; and wherein said part A is formed with a central hole and has at least two holed ears formed peripherally and symmetrically thereon and extending outwardly from said part A's circumference, for hoist cable attachment; said central hole of said part A being adapted to receive said part B, said part B comprising a pair of elongated flat members connected to each other by means of a pivot pin located approximately midway, the upper portions of said members being called blades and the lower portions being called handles, extending downward, the lower end of each of said handles having a hole for cable attachment; said part B having a recess adjacent to said pivot pin when said part B's blades are spread apart, wherein the improvement comprises in said magnetic part C being disposed snugly in said recess of said part B to lock said coupling device in place and prevent the closure of said blades, said recess having two flat, parallel sides and a flat bottom surface; and wherein said magnetic part C is essentially a rectangular shaped prism, said prism having two flat, parallel opposite surfaces with the two said parallel surfaces engaging the two said parallel sides of said recess of said part B, said magnetic part C locking said part B in open-blade position, for suspended load conditions, and with an unloading cord attached to said said part C for remote manual removal of said part C from said device, by pulling on said cord in a direction parallel to said parallel sides of said recess to cause said part C to slide off of said bottom surface of said part B, to enable the separation of said part B from said part A.

2. A device in accordance with claim 1, and wherein said part A is the lower part, and said part B is the upper part of said coupling device, so that said device may be used in either an upward or a downward position.

3. A device in accordance with claim 1, and including a restraining cord having one end attached to a pin on one of said handles and having its other end attached to the plunger of a solenoid, imbedded in the other of said handles near said midsection of said part B, and including a length of unloading cord with its one end fastened to said part C, for manual removal of said part C, and including electric circuit wiring, a voltage source, a switch and an electrically-energized solenoid having a normally-extended plunger, wherein said switch is located at the free end of said unloading cord, and said cord having included within itself said electric circuit wiring; and wherein said restraining cord prevents the removal of said part C until said electric circuit is closed by manually closing said switch, said electric circuit wiring containing said switch and said voltage source in said wiring, to enable a person, with said switch in hand, to apply said voltage source to said solenoid, said voltage to cause said plunger to retract and to enable the removal of one end of said restraining cord, allowing the removal of said part C by pulling on said unloading cord, resulting in the uncoupling of said part C from said part B.

4. A device in accordance with claim 1, where both said sides of said recess of part B and said flat parallel opposite surfaces of said magnetic part C are tapered slightly inward, so that when part C is engaged with said recess of part B, said magnetic part C is prevented from being pulled out perpendicularly to said flat members of said part B.

5. A device in accordance with claim 1, wherein said part B has a second said recess on the reverse side of said part B, like scissors, a second identical said magnetic part C is disposed in said second recess when said blades of said part C are spread apart; thus enabling said structural coupling device to have the capability to suspend heavier cargo for the same size device, than said part B with only one of said magnetic part C.

6. A device in accordance with claim 1, and wherein said independent doughnut-shaped part A is formed with a central square or rectangular hole.

7. A hoist cable coupling device for quickly releasing suspendd cargo, comprising an doughnut-shaped part A, an independent scissor-like part B with a pull-type solenoid attached thereto, all for use with hoist and load cables, both said cables being adapted for attachment to parts A and B; and wherein said part A is formed with a large central hole and has at least two holed-ears formed peripherally and symmetrically located thereon and extending outwardly from said part A's circumference for hoist cable suspension; said central hole of said part A being adapted to receive part B approximately half way, said part B being scissor-like with two lower handles, each having a hole for cable attachment, said handles extending downward in operation, and said part B including a pair of blades at the upper portion of said part B; said part B being pivoted substantially at the midsection of said part B by means of a pivot pin; wherein the improvement comprises in said part B having said pull-type solenoid on one of said handles near said midsection of said part B, (becoming an integral part of said part B), and said part B having a recess with two opposite vertical parallel sides adjacent to said pivot pin when said part B's blades are spread apart, and criss-cross like scissors; said pull-type solenoid having a plunger with two mating flat, vertical parallel opposite surfaces, and when said plunger is disposed snugly in said recess of said part B, when extended, locks said coupling in place, preventing the closure of said blades, said plunger to maintain the spread-apart position of said blades of said part B, to prevent the disengagement of said part A from said part B, under suspended load conditions, whereby energizing said solenoid would cause said plunger to retract, under no load conditions, allowing said coupling device to decouple, thus releasing said cargo onto a platform below.

8. A device in accordance to claim 7, wherein said plunger has a top and said part B has a face, and wherein both said sides of said recess of part B and said flat parallel opposite surfaces of said plunger are tapered slightly inward toward said top, instead of being perpendicular to said face of said scissor-like part, so that when said device is under suspended light load conditions said plunger can retract more easily when energized and permit said blades of said part B to come together and slip through said central hole of said part A, in order to uncouple said device and jettison said suspended load under emergency conditions.

9. A hoist cable coupling device in accordance with claim 7, including an independent magnetic part C with attached cord and an electrical circuit including a switch and a voltage source for said solenoid, wherein said recess of said part B can either accept said plunger of said solenoid, protruding through said recess of said part B to prevent the closing together of said part A's blades, or accept said magnetic part C, shaped to occupy the area of said recess, when said solenoid is removed, in order to provide the user with a choice of either manual operation of said device by pulling on said attached cord or remote electrical operation by momentarily depressing said switch to close said electrical circuit, thus energizing said solenoid and causing said plunger to recede.

10. A device in accordance with claim 7, and wherein said independent doughtnut-shaped part A is formed with a central square hole.

11. A device in accordance with claim 7, and wherein said part B has a second recess on the reverse side of said part B also with flat opposite vertical parallel sides, like scissors, and wherein a magnetic part C, also having flat, opposite parallel sides, can be disposed snugly in said recess of said part B to lock said coupling device in place, and thus provide both additional suspended load capabiltiy and safety capability to prevent the closure of said blades, when said device, with suspended cargo attached, is subjected to wind gusts and other unanticipated dynamic loading conditions.

12. A hoist cable coupling device for quickly releasing suspended cargo by remote signal means, comprising an rectangular-shaped part A, a scissor-like part B and a solenoid attached thereto, all for use with hoist and load cables, both said cables being adapted to attachment to parts A and B;

and wherein said part A is formed with a central rectangular hole that has at least two holed-ears formed periphrally and symmetrically located thereon and extending outwardly from said part A's exterior for hoist cable suspension; said central hole of said part A being adapted to receive said part B approximately half-way, said part B being scissor-like with two lower handles, each having a hole for load cable attachment, and said handles extending downward in operation, and said part B including a pair of blades at the upper portion of said part B; said part B being pivoted substantially at the midsection of said part B by means of a pivot pin, said part B having a rotary solenoid, with a left-hand stroke of 90° rotation, mounted on one of said handles near said midsection of said part B, and wherein the improvement comprises in said part B having a recess with two opposite vertical parallel sides adjacent to said pivot pin when said part B's blades are spread apart, criss-cross like scissors; and said rotary-type solenoid having a shaft with two flat vertical parallel opposite surfaces, and when unenergized said shaft being disposed snugly in said recess of said part B to lock said coupling device in place and prevent the closure of said blades, said holed-handles of said part B serving to receive said load cables which support said cargo, and said load cables being fastened firmly to said cargo and to said holed-handles, and said hoist cables, disposed above said device, being fastened to said holed-ears of said part A, said shaft to maintain the spread-apart position of said blades of said part B and thus prevent the disengagement of said part A from said part B, under suspended load conditions.

13. A hoist cable coupling device in accordance with claim 12, and wherein said shaft has an enlarged cylindrical part centrally located and firmly fastened to said shaft of said solenoid, and said cylindrical part having opposite vertical parallel sides, and said recess having sides, each of said sides having a curved indentation to accommodate to curvature of said cylindrical part, when said cylindrical part is oriented to lock said scissor-like part in place with said blades spread apart; to disengage part B from said part A, said solenoid is energized causing said cylindrical part to rotate an arc of 90 degrees, thus allowing said blades to come together sufficiently for said part B to separate from said part A.

* * * * *